US005414873A

United States Patent [19]

Wolf

[11] Patent Number: 5,414,873

[45] Date of Patent: May 16, 1995

[54] HAMMOCK CONSTRUCTION WITH REPLACEABLE HAMMOCK MATERIAL AND ADJUSTABLE HANGER ASSEMBLY

[75] Inventor: Gary Wolf, Weston, Mass.

[73] Assignee: Heliotrope, LLC, Providence, R.I.

[21] Appl. No.: 201,801

[22] Filed: Feb. 25, 1994

[51] Int. Cl.[6] ..... A45F 3/22; A45F 3/24

[52] U.S. Cl. ..... 5/122; 5/120; 5/127

[58] Field of Search ..... 5/120–123, 5/127–130; D6/386, 387

[56] References Cited

U.S. PATENT DOCUMENTS

| | | | |
|---|---|---|---|
| 944,661 | 12/1909 | Buck | 5/129 |
| 2,353,220 | 7/1944 | Charlop | 5/128 |
| 2,745,115 | 5/1956 | Reiss | 5/122 |
| 2,761,153 | 9/1956 | Mew | 5/197 |
| 4,800,601 | 1/1989 | De Caro | 5/122 |

FOREIGN PATENT DOCUMENTS

| | | | |
|---|---|---|---|
| 2447696 | 8/1976 | Germany | 5/127 |

*Primary Examiner*—Alexander Grosz
*Attorney, Agent, or Firm*—Salter & Michaelson

[57] ABSTRACT

A hammock construction includes an elongated, tubular frame having symmetrical serpentine end portions which are supported above a supporting surface, and further includes a hammock which is supported between the end portions of the frame with hanger assemblies. The frame is supported either on two transverse legs or on a central rotatable pedestal which allows the hammock to rotate with respect to the supporting surface. The hanger assemblies each consist of an extension rod connected to a respective end of the frame, a V-shaped hanger rod and a hanger spar. The extension rod includes a plurality of reverse, or serpentine, bends therein for adjustably receiving the hanger rod of the hanger assembly. The hanger spar consists of an elongated tubular rod having a longitudinal groove therein. The V-shaped hanger rod includes two legs which diverge outwardly from an apex terminating in free ends. The free ends of the hanger rod are bent inwardly and are received into the open ends of the tubular hanger spar. The ends of the hammock fabric are folded over to form a loop and a length of cordage is extended through the loop. The loop and cordage at each end of the hammock are slidably received into the longitudinal grooves in the hanger spar. The apex portions of the hanger rods are received into one of the serpentine bends in the extension rods at each end of the frame to adjustably suspend the hammock between the two end portions of the frame.

13 Claims, 5 Drawing Sheets

HAMMOCK CONSTRUCTION WITH REPLACEABLE HAMMOCK MATERIAL AND ADJUSTABLE HANGER ASSEMBLY

BACKGROUND AND SUMMARY OF THE INVENTION:

The instant invention relates to hammock constructions and more particularly to a hammock construction with a replaceable hammock material and an adjustable hanger assembly.

A variety of hammock constructions have heretofore been known in the art. However, none of the prior art hammock constructions have included means for easily replacing the hammock material of the hammock when the hammock material becomes worn from use. Typically, the hammock portion of a hammock construction is integrally constructed with the hanger portion. Accordingly, when the hammock portion of the hammock construction becomes worn or torn, both the hammock and hanger portions must be completely replaced. Another drawback to the prior art hammock constructions is that the frame structure, in particular the supporting arms, are not designed with any type of flexibility to absorb upward and downward movement of the hammock during use.

The instant invention provides a hammock construction comprising an elongated, aluminum tubular frame having symmetrical serpentine ends which are supported above a supporting surface, and further comprises a hammock which is supported between the end portions of the frame with adjustable hanger assemblies. The frame is supported on the supporting surface either by two transverse legs, or by a pedestal which is secured to the supporting surface. The pedestal includes a bearing assembly which allows rotation of the frame with respect to the pedestal base. The hanger assemblies each consist of an extension rod connected to a respective end of the frame, a V-shaped hanger rod and a hanger spar. The extension rod includes a plurality of reverse, or serpentine, bends therein which are operative for adjustably receiving the hanger rod therein. The hanger spar consists of an elongated tubular rod having a longitudinal slot, or groove, therein. The V-shaped hanger rod comprises two legs which diverge outwardly from an apex terminating in free ends. The free ends of the hanger rod are bent inwardly and are received into the open ends of the tubular hanger spar. The ends of the hammock fabric are folded over to form a loop, and a length of cordage is extended through the loop. The loop and cordage at each end of the hammock are slidably received into the longitudinal slots in the hanger spars similar to the way a sail is received into the spar of a sail mast. The apexes of the hanger rods are received into one of the serpentine bends in the extension rods at each end of the frame to suspend the hammock between the two end portions of the frame. The hammock position may be adjusted by moving the hanger rod apex to different serpentine bends up and down the length of the extension rods. The spar-type construction of the hanger assemblies allow the hammock fabric to be easily removed and replaced with another type or color fabric, or to be replaced when damaged.

Accordingly, it is an object of the instant invention to provide a hammock construction having a flexible frame structure.

It is another object to provide a hammock construction with means for replacing or substituting only the fabric hammock portion thereof.

It is another object to provide a hammock construction with an adjustable hanger assembly.

It is still another object to provide a hammock construction that is supported on a rotatable central pedestal.

Other objects, features and advantages of the invention shall become apparent as the description thereof proceeds when considered in connection with the accompanying illustrative drawings.

DESCRIPTION OF THE DRAWINGS:

In the drawings which illustrate the best mode presently contemplated for carrying out the present invention.

Figure 1:
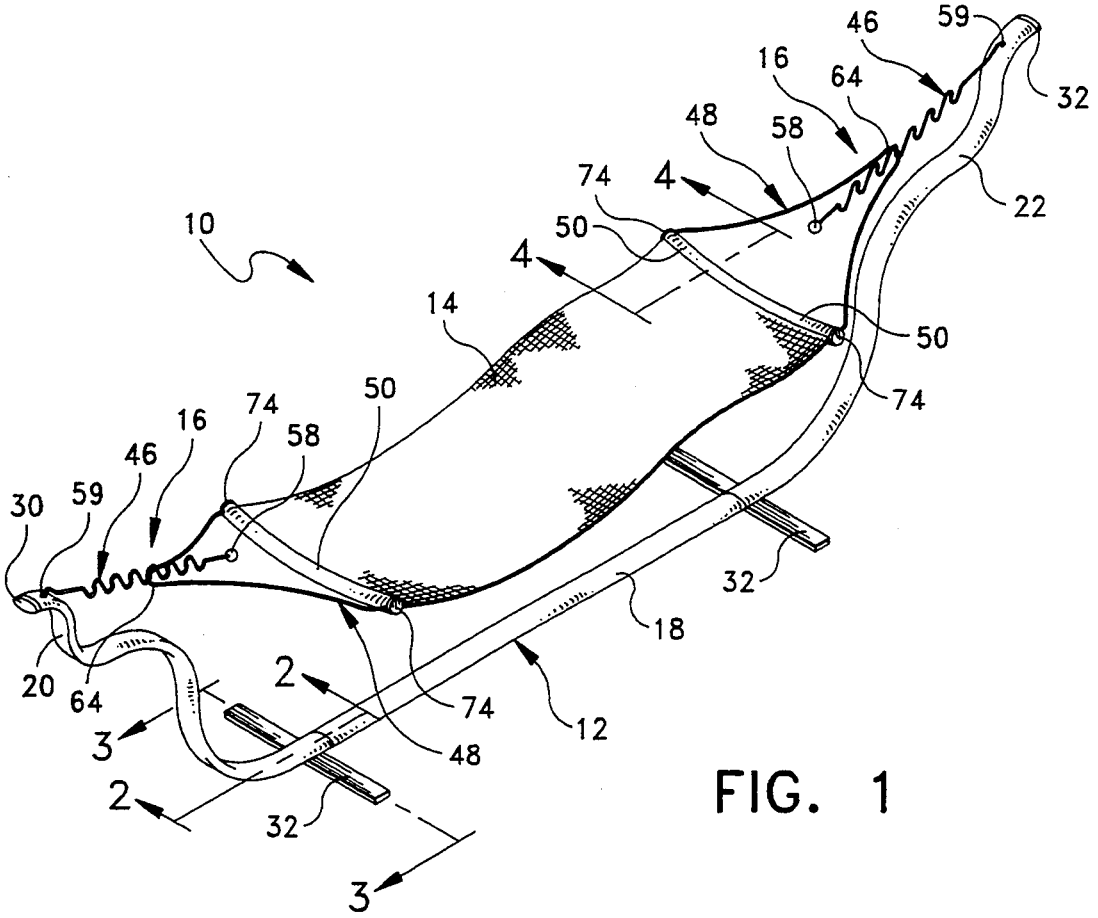
FIG. 1 is a perspective view of the instant hammock construction.

DESCRIPTION OF THE PREFERRED EMBODIMENT:

Referring now to the drawings, the hammock construction of the instant invention is illustrated and generally indicated at 10 in FIG. 1. As will hereinafter be more fully described, the instant hammock construction 10 includes a removable hammock portion, an adjustable hanger assembly to vary the tension of the hammock fabric, and a flexible frame structure.

The hammock construction 10 comprises an elongated frame structure generally indicated at 12, and further comprises a hammock 14 which is supported between the end portions of the frame 12 by adjustable hanger assemblies generally indicated at 16.

Figure 2:
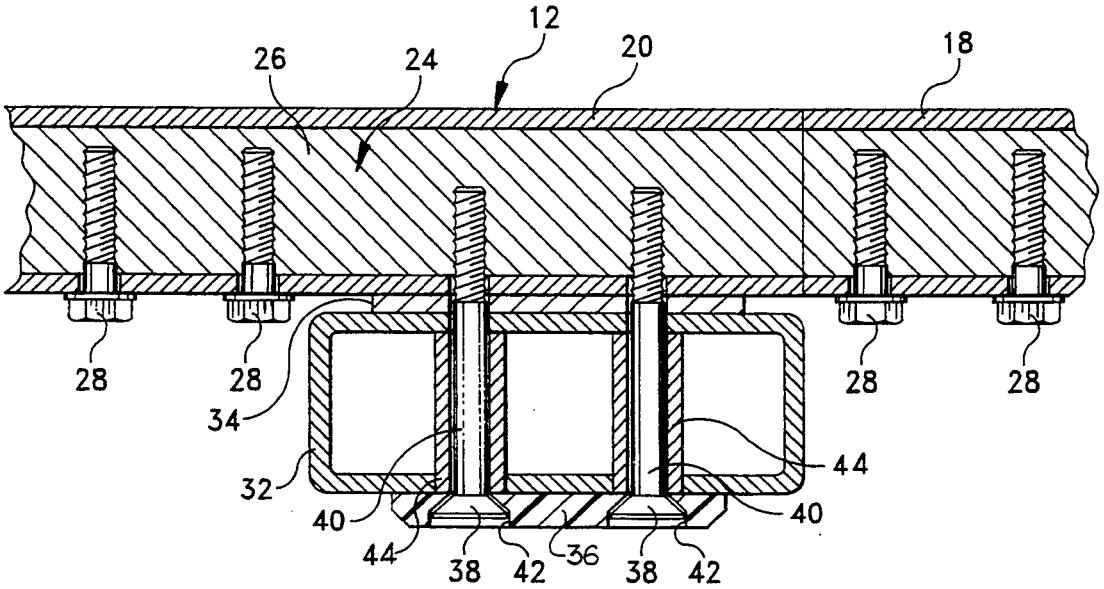
FIG. 2 is a cross-sectional view of the leg assembly thereof taken along line 2—2 of FIG. 1.

The frame 12 is preferably constructed from three separate aluminum tubular extrusions having oval cross-sections. More specifically, the frame 12 comprises a linear center portion 18, and first and second symmetrical ends portions 20 and 22, respectively, connected to the opposite ends of the linear center portion 18. Each of the end portions 20 and 22 of the frame 12 extends upwardly and outwardly from the center portion and includes reverse, or serpentine-like, curves therein. The serpentine end portions 20 and 22 preferably include four reverse curves, each curve having a decreasing radius as they extend upwardly and outwardly from the center frame portion 18. The serpentine bends of the frame structure 12 are effective for providing the frame 12 with a limited degree of flexibility to effectively cushion or absorb the weight of the user reclining on the hammock 10. The three separate frame portions 18, 20, and 22 are held together by aluminum connector inserts 24 (FIG. 3) which have an outer peripheral surface generally equal in dimension to the inner peripheral dimension of the frame sections 18, 20 and 22. The aluminum connectors 24 further include a solid longitudinal central rib 26 extending therethrough. The aluminum connector elements 24 are slidably received into the open ends of the tubular center portion 18 and the open ends of the tubular end portions 20 and 22 so that the frame 12 appears to comprise one continuous tubular extrusion. The connector elements 24 and tubular frame portions 18, 20 and 22 are secured together with threaded screws, or bolts 28, (FIG. 2) which extend upwardly through the outer wall of the respective tubular frame portion and into the solid rib portion 26 of the internal connector element 24 (FIG. 2). The position of the bolts 28 underneath the frame 12 conceals them from view. The open ends of the tubular end portions 20 and 22 are provided with protective rounded end caps 30.

Figure 3:
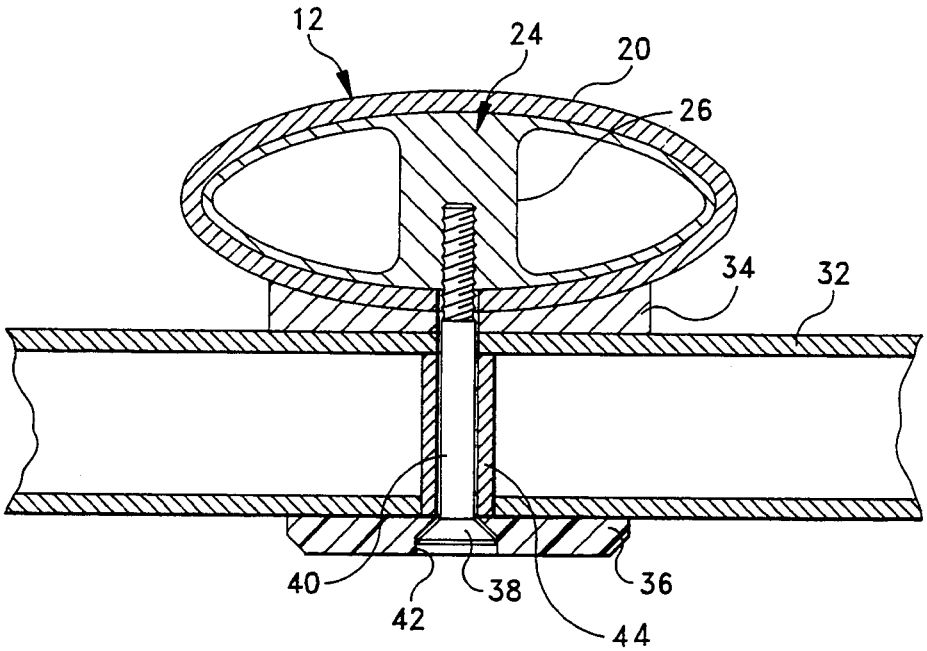
FIG. 3 is another cross-sectional view of the leg assembly thereof taken along line 3—3 FIG. 1.

The frame 12 is supported on a supporting surface by two transverse legs 32 which are positioned at opposite ends of the frame structure 12 and fixedly connected to the frame structure 12 (FIGS. 1–3). The legs 32 preferably comprise sections of rectangular aluminum tubing. Since the frame structure 12 has an oval outer surface and the legs 32 have a flat outer surface, a contoured aluminum spacer 34 (FIGS. 2 and 3) is positioned between each of the legs 32 and the frame 12 to provide a stable supporting interface therebetween. In addition, a plastic glider 36 is received onto the bottom of the transverse leg 32 to prevent the heads 38 of the securing bolts 40 from scraping against the supporting surface. In this regard, the gliders 36 include recessed apertures 42 for receiving the heads 38 of the securing bolts 40 therein. The securing screws 40 extend upwardly through the glider 36, legs 32, spacer 34 and frame section 20 into the solid rib 26 of the connector element 24 to secure the entire leg assembly together. Each leg 32 further includes two additional gliders (not shown) which are positioned on opposite ends of the legs 32 to prevent the hammock from tilting on the central glider 36. In order to provide stability to the rectangular legs 32 where the bolts 40 extend therethrough, the bolts 40 are received through metal sleeves 44 (shown in cross-section) which are received into the legs 32 through enlarged apertures in the bottom of the legs 32.

Figure 5:
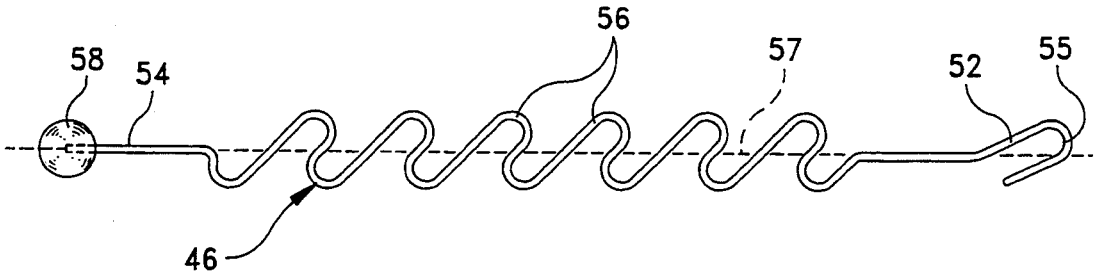
FIG. 5 is an elevational view of the extension rod thereof.

The hanger assemblies 16 each consist of an extension rod generally indicated at 46 connected to a respective end of the frame 12, a V-shaped hanger rod generally indicated at 48, and a hanger spar generally indicated at 50. The extension rod 46 (FIG. 5) preferably comprises a stainless steel rod having first and second ends 52 and 54, respectively, and a plurality of reverse, or serpentine, bends 56 formed therein. The serpentine curves 56 are preferably formed at an angle of 45 degrees with respect to a longitudinal centerline 57 of the rod 46, however any angle between about 20 and 60 degrees is suitable. The first end 52 of the extension rod 46 is formed with a U-shaped bend 55, and the second end 54 is provided with a protective plastic ball 58 which is operative for preventing possible head injury when a user is reclining on the hammock 14 (see FIG. 1). The extension rods 46 are attached to the frame ends 20 and 22 by inserting the U-shaped bends 55 into apertures 59 formed in the top of the frame ends 20 and 22.

The hanger spar 50 comprises an aluminum tubular rod having a longitudinal groove 60 therein. The spar 50 is formed with a slight curvature to allow the hammock 14 to more closely conform and wrap around a person lying in the hammock 14.

The V-shaped hanger rod 48 comprises a stainless steel rod generally bent into the shape of a triangle. More specifically, the hanger rod 48 includes two legs 62 which diverge outwardly from an apex 64 and terminate in spaced free ends 66. The legs 62 are formed with a slight curvature, as illustrated in FIG. 1. The free ends 66 of the hanger rod 48 are in turn bent inwardly as indicated at 68 and are received into the open ends of the tubular hanger spar 50 to secure the hanger rod 48 and spar 50 together as an integral unit.

Figure 4:
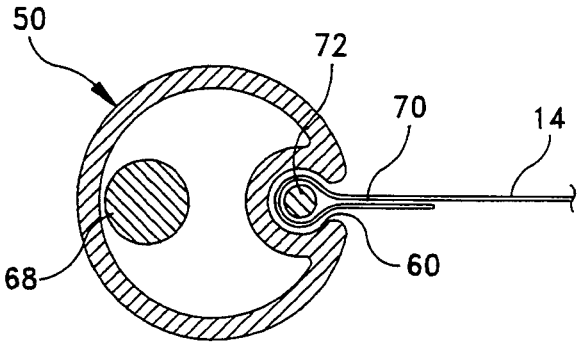
FIG. 4 is a cross-sectional view of the spar assembly thereof taken along line 4—4 of FIG. 1.

The hammock 14 preferably comprises a generally rectangular piece of fabric preferably having weatherproof qualities, such as SUNBRELLA brand fabric (SUNBRELLA is a registered trademark of Glen Raven Mills, Inc.) or TEXTILENE brand fabric (TEXTILENE is a registered trademark of Ludlow Corp). The ends of the hammock fabric 14 (FIG. 4) are folded over to form a loop 70, and a length of textile cordage 72 is extended through the loop 70 (FIG. 4). The loop 70 and cordage 72 at each end of the hammock 14 are slidably received into the longitudinal groove 60 in the hanger spar 50 similar to the way a sail is received into the spar of a sail mast. Protective end caps 74 are received over the ends of the hanger spar 50 to conceal the open ends of the spar tubing, provide a rounded surface which is less likely to cause injury, and capture the hammock 14 and hanger rods 48 within the spar 50. The spar-type sliding interface of the hammock fabric 14 and the hanger spar 50 enables the fabric 14 to be easily replaced with another color fabric where desired, or to replace the fabric 14 when it becomes worn.

Figure 7:
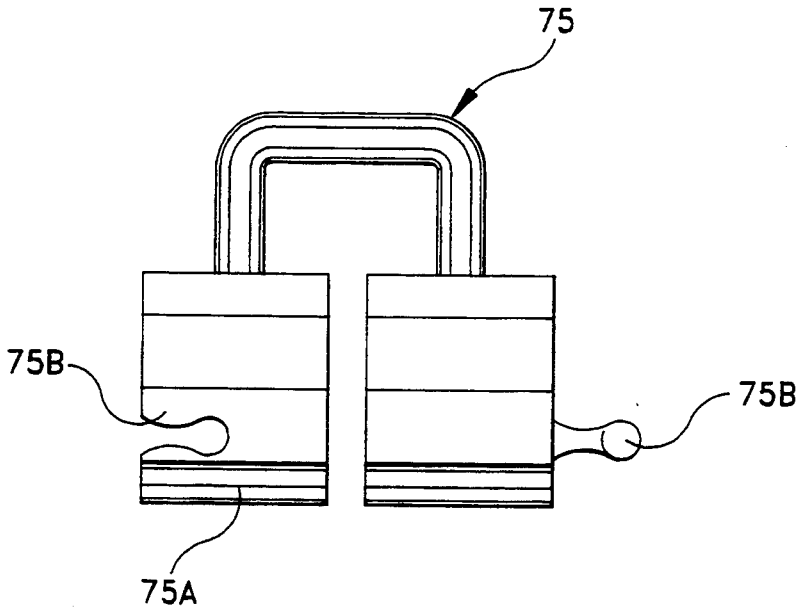
FIG. 7 is a plan view of a slide member for an alternative rope hammock.
Figure 8:
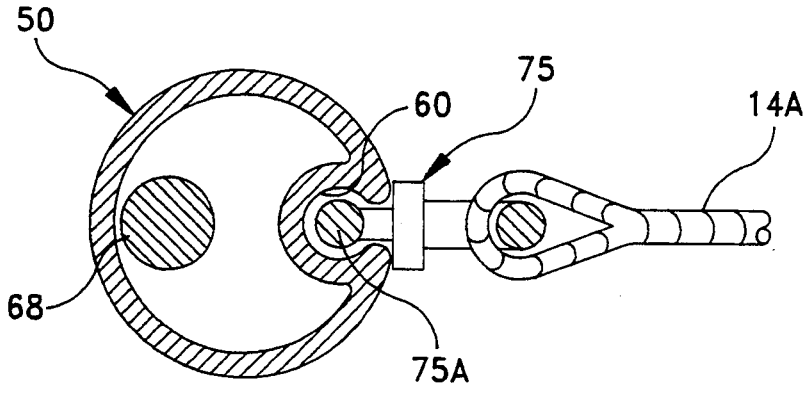
FIG. 8 is a fragmented cross-sectional view of the slide member attached to the alternative rope hammock.
Figure 6:
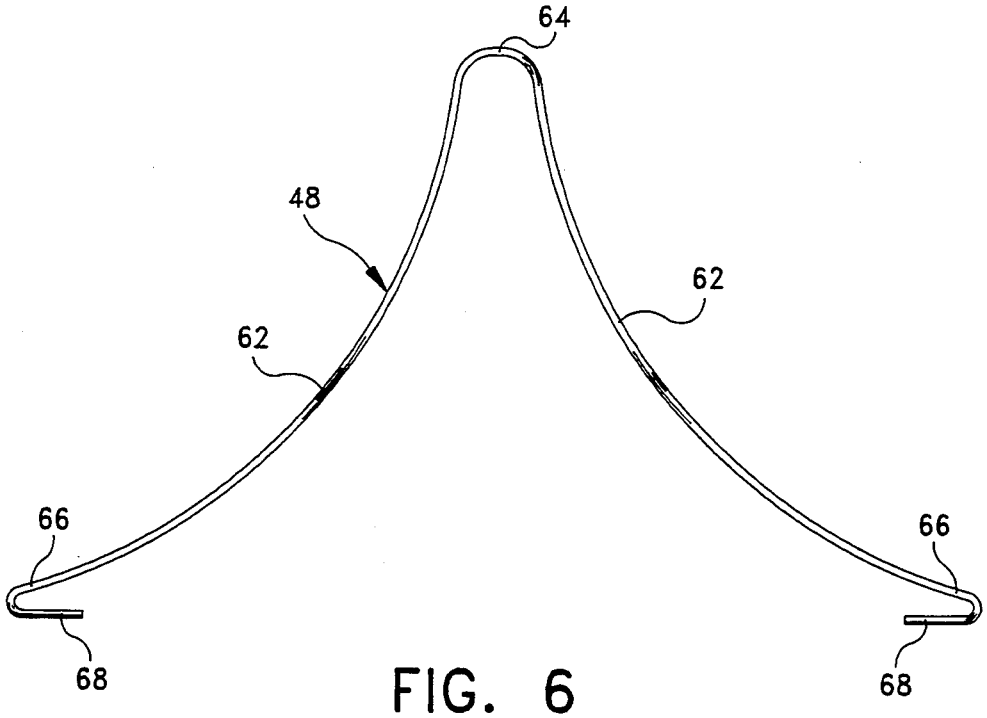
FIG. 6 is an elevational view of the hanger rod thereof.

The hammock 14 may alternatively comprise a braided rope hammock 14A wherein a plurality of slide connectors generally indicated at 75 (FIG. 7) are attached to thereto. A slide bar portion 75A of each slide connector 75 is slidably received into the longitudinal groove 60 of the spar 50 (FIG. 8) to suspend the rope hammock 14A between the hanger assemblies 16. The slide connectors 75 are provided with connector elements 75B to link the slide connector together.

In use, the apex portions 64 of the hanger rods 48 are received, or hung, in the troughs of the serpentine bends 56 in the extension rods 46 at each end of the frame 12 to suspend the hammock 14 between the two end portions of the frame 12. The position, or tension, of the hammock 14 may be adjusted by moving the hanger rod apex 64 to different serpentine bends 56 up and down the length of the extension rods 46. As can be seen in FIG. 1, the extension rods 46 angle slightly downwardly from the frame ends 20 and 22. In this connection, the serpentine bends 56 are angled with respect to the extension rod 46 so that the apexes 64 of the hanger rods 48 are received securely therein. If the bends 56 were formed perpendicular to the centerline 57, the apexes 64 would be likely to slip out of the bends 56 resulting in collapse of the hammock.

Figure 9:
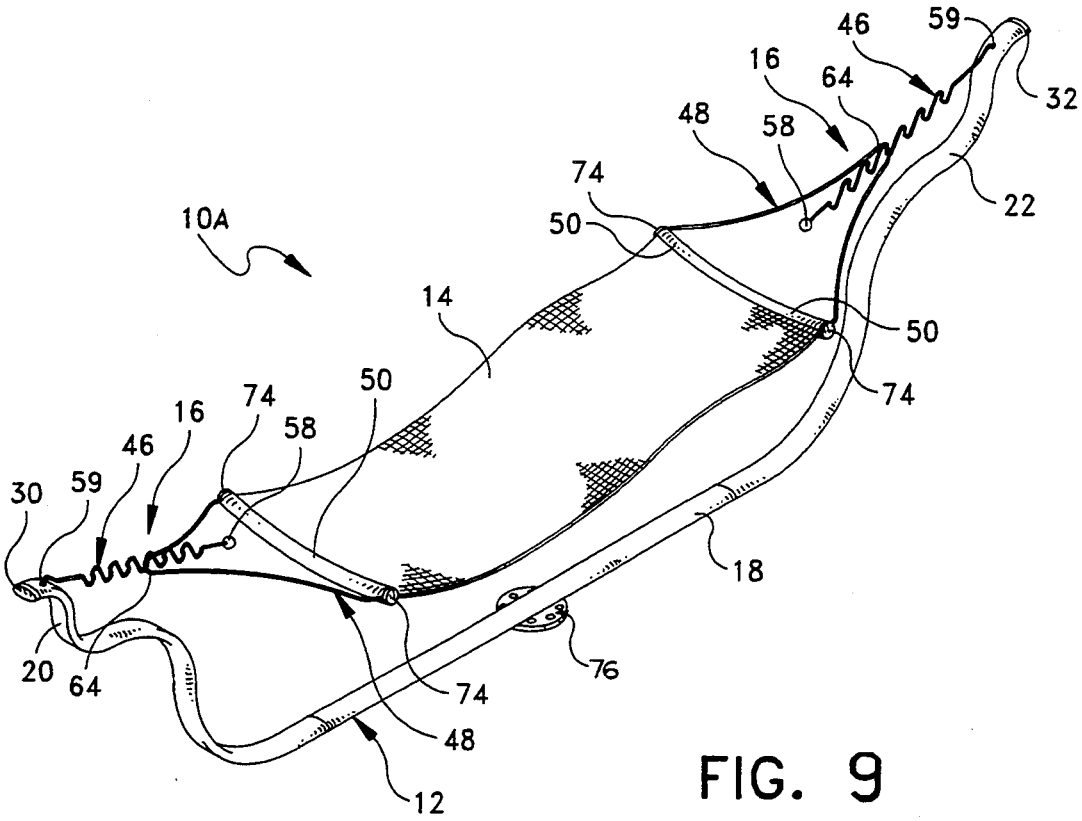
FIG. 9 is a perspective view of the hammock construction with an alternative rotatable pedestal base.
Figure 10:
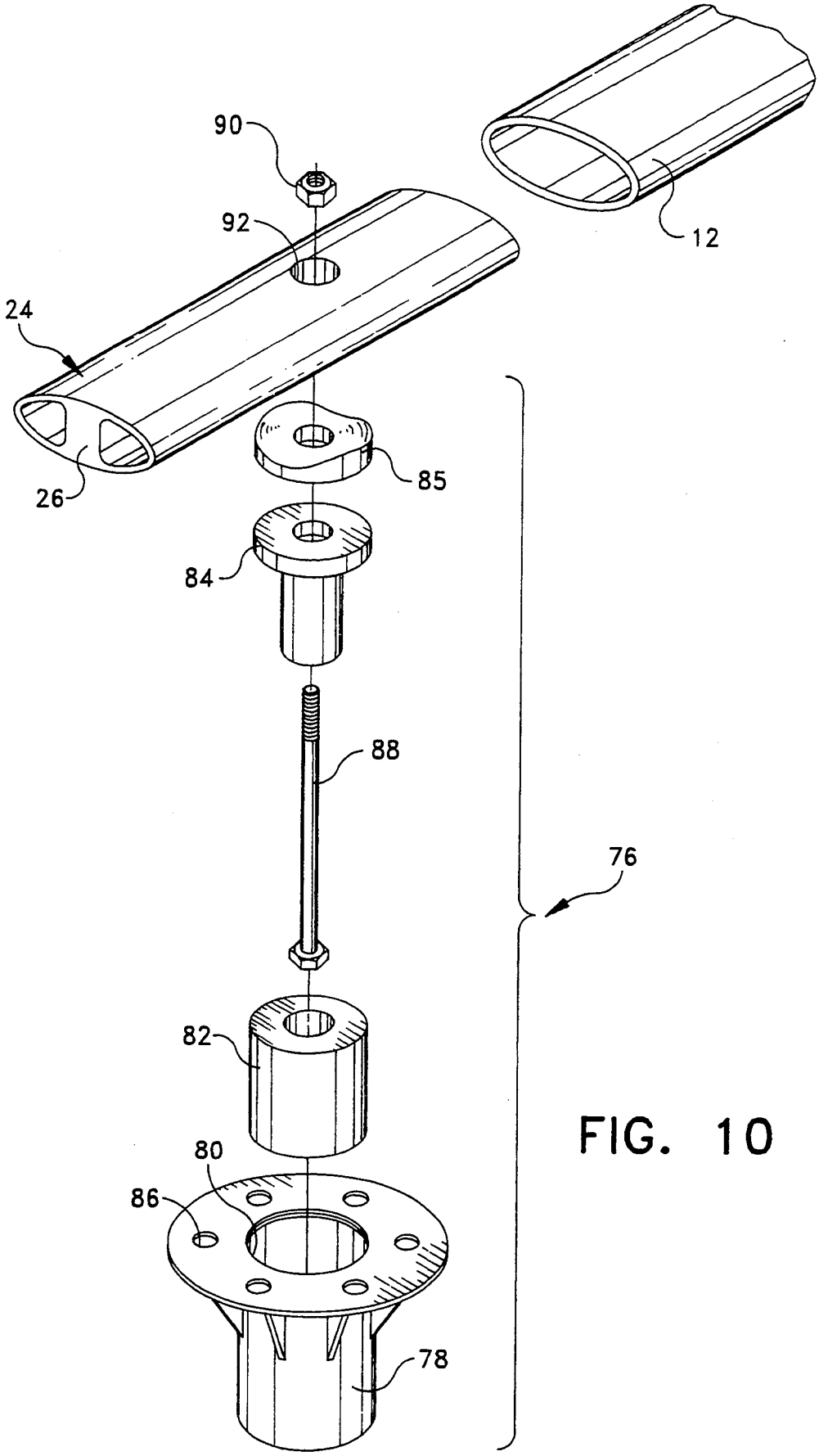
FIG. 10 is an exploded assembly view of the rotatable pedestal base.

An alternative embodiment of the hammock construction is generally indicated at 10A in FIG. 9, wherein the frame structure 12 is supported on a rotatable central pedestal generally indicated at 76. The rotatable pedestal 76 is fixedly secured to a supporting surface and enables the hammock 10A to rotate with respect to the pedestal 76. More specifically, the pedestal 76 comprises a cylindrical cast aluminum base 78 having an axial bore 80 therein, and further comprises a bronze bearing cup 82, a bronze bearing insert 84 which rides in the bearing cup 82, and a contoured aluminum spacer 85. The cast aluminum base 78 is secured to any suitable supporting surface, such as a wooden deck, or a concrete patio, by means of bolts (not shown) which are extended through mounting apertures 86 therein. The bearing cup 82 is received into the axial bore 80 in the base 78. The bearing insert 84 is secured to the frame 12 by a bolt 88 which extends through the bearing insert 84, the aluminum spacer 85, the outer wall of the frame 12, and into a nut 90 which is press received into an aperture 92 in the surface of an aluminum connector insert 24 received inside the tubular frame 12. The contoured spacer 85 provides a stable supporting interface between the bearing insert 84 and the oval frame 12. The bearing insert 84 is snugly, yet removeably, received into the bearing cup 82 in the base 78, wherein the insert 84 and attached frame 12 are rotatable with respect to the bearing cup 82 and the base 78. The snug fit of the bearing cup 82 and bearing insert 84 provides friction so that the frame 12 will not freely spin, yet will easily rotate when a minimal force is applied thereto.

In use, the hammock 10A is fully rotatable on the pedestal 76 through 360 whereby the user can more fully take advantage of the angle of the sun as it moves through the sky. In addition, the hammock 10A can be removed from the base 78 and stored in a shed when not in use.

It can therefore be seen that the instant invention provides a unique hammock construction 10. The serpentine bends of the frame structure 12 provide the frame 12 with a limited degree of flexibility to effectively cushion or absorb the weight of the user reclining on the hammock 14. Further, the unique serpentine hanger assembly 16 allows quick and easy adjustment of hammock tension. Still further, the spar-type interface of the hammock fabric 14 and the hanger assembly 16 permits easy replacement of the hammock fabric 14 when desired. In an alternative embodiment, the frame 12 is mounted on a rotatable pedestal 76 which enables the entire hammock structure to rotate. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A hammock construction comprising:

an elongated frame having first and second spaced ends which are positioned above a supporting surface;

base means for supporting said frame on said supporting surface;

an extension rod connected to each of said first and second ends of said frame, said extension rods each having a plurality of reverse curves formed along the length thereof;

a hammock having first and second ends;

a V-shaped hanger rod connected to each of said first and second ends of said hammock, said V-shaped hanger rods each having leg portions which diverge outwardly from an apex and terminate in free ends wherein said free ends are fixedly attached to said respective ends of said hammock, said apexes of said hanger rods being received into one of said reverse curves in said extension rods whereby said hammock is suspended between said first and second spaced arms of said frame.

2. In the hammock construction of claim 1, said extension rod having a longitudinal centerline, said reverse curves being angled between about 20 and 60 degrees with respect to said centerline.

3. In the hammock construction of claim 1, said base means comprising two spaced transverse legs.

4. In the hammock construction of claim 1, said base means comprising a pedestal centered between said first and second ends of said frame.

5. In the hammock construction of claim 4, said pedestal including a base attached to a supporting surface and means for rotating said hammock relative to said base.

6. In the hammock construction of claim 1, said first and second ends of said hammock each including an elongated tubular rod secured thereto, said free ends of said hanger rods bending inwardly and being received into the ends of said tubular rods.

7. A hammock construction comprising:

a frame having first and second spaced ends which are positioned above a supporting surface;

base means for supporting said frame on said supporting surface:

a hammock having first and second ends which are folded over and secured to form loops, said loops each having a length of cordage extending therethrough;

a hanger assembly for respectively suspending each of said first and second ends of said hammock from said first and second ends of said frame, said hanger assembly including a rigid, tubular spar, formed with a curvature, having first and second ends and further having a longitudinal groove formed therein extending between said first and second ends, said hanger assembly further including meads for securing said tubular spar to the end of said frame comprising a V-shaped hanger having leg portions which diverge outwardly from an apex and terminate in free ends wherein said free ends are fixedly attached to said first and second ends of said spar, said apexes being removably secured to the first and second ends of said frame, said looped ends of said hammock being slidably received into said longitudinal groove in said spar to suspend said hammock between said first and second ends of said frame.

8. In the hammock construction of claim 7, said base means comprising a pedestal, said pedestal including a base attached to a supporting surface and means for rotating said frame relative to said base.

9. The hammock construction of claim 7 wherein said free ends of said V-shaped hanger are bent inwardly and are received in the respective first and second ends of said tubular spar to secure said hanger and said spar together in assembled relation.

10. The hammock construction of claim 7 wherein said leg portion are formed with a curvature.

11. A frame construction for a hammock comprising: an elongated substantially linear center portion received adjacent a supporting surface, and first and second symmetrical end portions which extend upwardly and outwardly from said center portion, said first and second end portions each including at least two reverse curves which first curve upwardly from said center portion and then curve outwardly terminating in a free end, said hammock being suspended between said free ends of said frame construction, said end portions providing flexibility to said frame.

12. In the frame construction of claim 11, said center portion and said first and second end portions each comprising a length of tubular steel, said frame construction further comprising connector elements for connecting said first and second end portions to said center portion, said connector elements having an outer peripheral dimension generally equal to an inner peripheral dimension of said tubular center portion and said end portions, said connector elements being slidably received into the open ends of said center portion and the open ends of said end portions, said connector elements being secured to said center portion and said first and second end portions with fastener members which extend through said center portion and said end portions and into said connector elements.

13. The frame construction as set forth in claim 11 wherein said reverse curves have a decreasing radius as they extend upwardly and outwardly from said center portion.

* * * * *